United States Patent [19]

Schmid

[11] 3,966,206

[45] June 29, 1976

[54] BOWLING PIN ALIGNMENT APPARATUS TO UNIFORMLY ALIGN BOWLING PINS END-FOR-END

[75] Inventor: August Schmid, Schwerzenbach, Switzerland

[73] Assignee: Patentverwertungs - und Finanzierungsgesellschaft, SERANIA, Glarus, Switzerland

[22] Filed: June 23, 1975

[21] Appl. No.: 589,182

[30] Foreign Application Priority Data

June 27, 1974 Switzerland ..... 8828/74

[52] U.S. Cl. ..... 273/43 E

[51] Int. Cl.[2] ..... A63D 5/08

[58] Field of Search ..... 273/43 R, 43 A, 43 E

[56] References Cited

UNITED STATES PATENTS

| | | | |
|---|---|---|---|
| 2,017,143 | 10/1935 | Bentz | 273/43 R |
| 3,272,508 | 9/1966 | Dowd et al. | 273/43 A |

FOREIGN PATENTS OR APPLICATIONS

| | | | |
|---|---|---|---|
| 2,022,939 | 12/1971 | Germany | 273/43 A |
| 346,807 | 7/1960 | Switzerland | 273/43 R |

*Primary Examiner*—Anton O. Oechsle
*Attorney, Agent, or Firm*—Flynn and Frishauf

[57] ABSTRACT

A support which can tip to release a bowling pin therefrom and which may be part of a transport mechanism, holds bowling pins in essentially horizontal position. A pair of sensing levers is arranged near the discharge position of the pins from the support, the sensing levers being horizontally spaced so that one lever will engage the neck or head portion of the pin, whereas the other lever will engage the bulged body portion thereof. The levers are interlocked in such a manner that the specific respective lever which senses presence of the head or neck portion therebeneath will remain in locked position during release movement of the support, whereas the other lever is free to release the pin, so that the pin will be restrained at the head or neck portion, regardless of its horizontal alignment, and always be tipped away from the support with the body portion first.

10 Claims, 10 Drawing Figures

BOWLING PIN ALIGNMENT APPARATUS TO UNIFORMLY ALIGN BOWLING PINS END-FOR-END

The present invention relates to apparatus to properly align bowling pins which are supplied thereto in random position and random alignment, so that the bowling pins will be supplied to pin spotting apparatus in predetermined alignment, and more particularly to such apparatus which is simple and can be combined with bowling pin transport apparatus, on which the pins are transported in random end-for-end alignment.

Bowling pin spotter apparatus in which the pins are not supported by support cables require that the bowling pins are supplied thereto in uniformly aligned direction; directional alignment apparatus should be as simple as possible, operate reliably, and without down time, and permit transporting of bowling pins supplied thereto in random orientation away from the apparatus in uniformly, properly aligned orientation, so that the pin spotting apparatus can then position the bowling pins in proper placement.

Various apparatus have been proposed to align bowling pins in automatic bowling alley installations. Such apparatus were, however, comparatively complicated and space-consuming, and required long travel paths, so that bowling pins which were not in a predetermined alignment direction had to be transported to a reversal mechanism before they could be placed in the desired alignment. Apparatus which is space-consuming is not suitable for many automatic bowling alley installations.

It is an object of the present invention to provide bowling pin alignment apparatus which is simple, requires little space, can readily be combined with other apparatus and which will effectively align bowling pins for placement in automatic bowling alleys.

SUBJECT MATTER OF THE PRESENT INVENTION

Briefly, the bowling pins are temporarily supported on a support surface, such as a support basket, bowling pin holder or the like, which preferably is arranged so that it can tip, or otherwise release the bowling pins, and which may form part of a bowling pin transport mechanism, such as a transport elevator. Two sensing levers are provided, spaced laterally from each other, and located so that one of them will engage a bowling pin in the region of the neck or head portion thereof, whereas the other will engage a bowling pin in the holder in the region of the bulged body portion. The sensing levers are connected to mutual interlocks which are so arranged that the lever which engages the head or neck portion is locked in position when the support is at a bowling pin release position, whereas the other lever is free to move. Thus, upon movement, for example tipping movement of the holder, the bowling pin will be released from the holder with the heaviest, that is the bulged body portion first, regardless of whether this bulged body portion was directed towards the right or towards the left of the essentially horizontal holder, so that, upon release, the alignment of the bowling pins will be uniform.

The apparatus, therefore, provides for reliable, uniform alignment of the bowling pins without requiring additional space, if any, and for alignment of the bowling pins as they pass through a chute, or other supply transport, to a pin spotter arrangement. The apparatus is simple, and reliable in operation.

The invention will be described by way of example with reference to the accompanying drawings, wherein.

Figure 1:
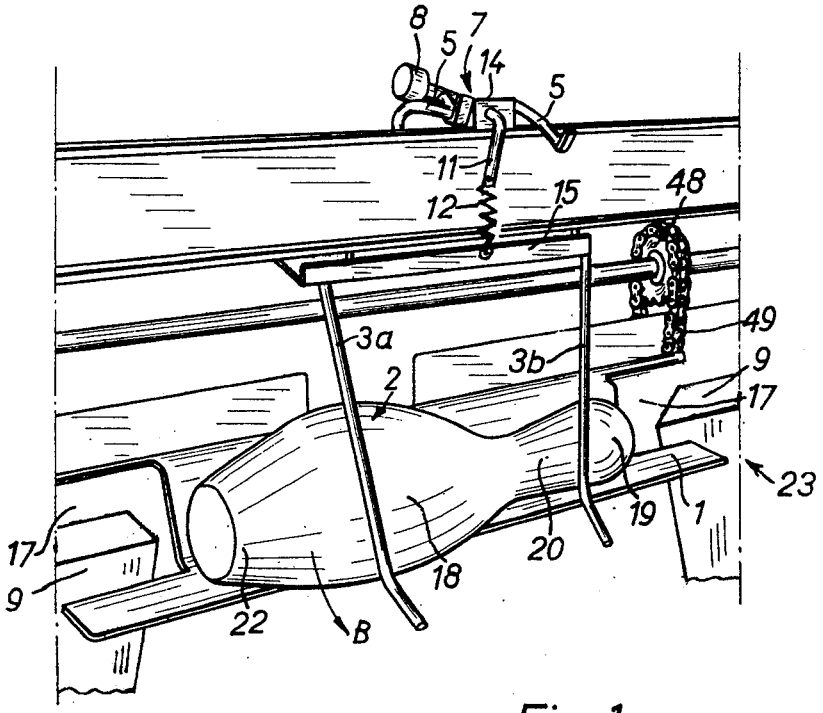
FIG. 1 is a schematic, perspective view of the apparatus in combination with a bowling pin transport elevator apparatus, and showing sensing of the alignment of a bowling pin.
Figure 6:
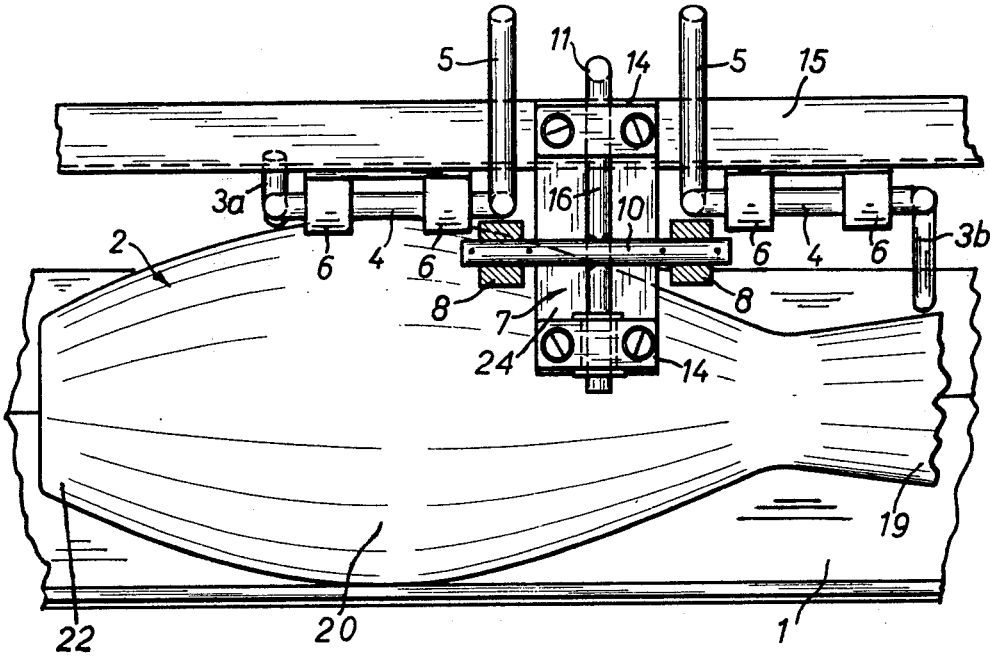
FIG. 6 is a top view of the apparatus, sensing a bowling pin.

Bowling pins 2 (FIG. 1) are transported horizontally from a bowling pin pit by means of an elevator mechanism 23. The pins 2 are supported on bowling pin baskets or holders 1 (FIGS. 1, 7, 8) which are pivotally secured at their ends to two chains 49, one, each, located at an end of the holder. The chains 49 are guided over reversal sprockets 48, located at the top and bottom of the elevator respectively. During upward movement, holders 1 are in the position illustrated in FIG. 7, that is, are aligned to hold bowling pins 2 in the holders 1. The holders 1 are rigidly secured to a horizontally extending support rod 46, for example by welding. An arm 30 is rigidly secured to the rod 46, to extend at an angle with respect to the holder 1. The ends of the cross rod 46 have each a roller 26 located thereon; a, preferably similar, roller 27 is located at the end of the arm 30. The chains 49 and the rollers 26, 27 are guides in U-shaped channel tracks 28. During upward movement, rollers 26, 27 are within the channel track 27, as clearly seen in FIG. 7. When the transport mechanism reaches the pin release position close to the upper sprockets 48, the groove of the channel 28 becomes enlarged, as clearly seen in FIG. 7. At this position, the roller 27 can deflect, thus causing deflection of arm 30, so that the holders 1 will assume the position shown in FIG. 8, permitting release of a bowling pin 2 from holder 1. The pins 2 fall out of the holder 1 in the direction of the arrow G (FIG. 8), to slide on a chute 31 to be transported to a pin spotting apparatus, not shown, and as known. The holders 1 are then returned to lower position by being reversed around the upper sprocket 48.

Figure 3:
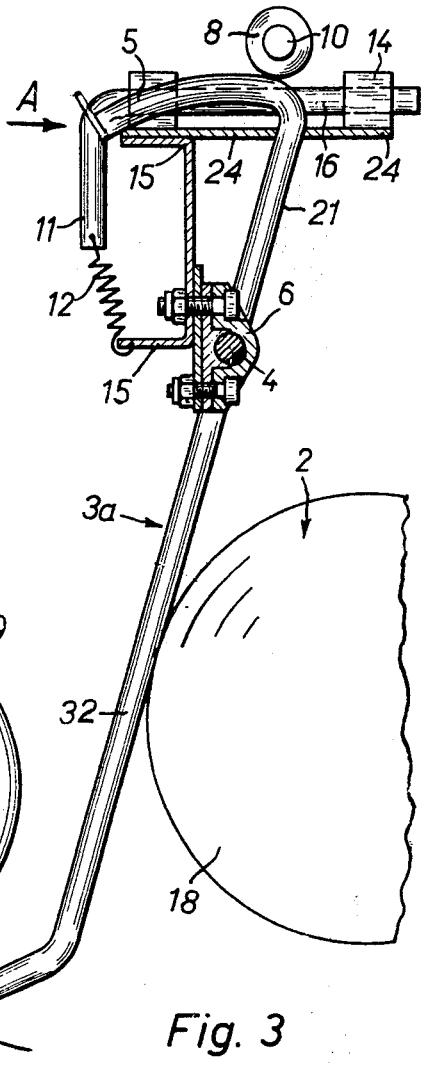
FIG. 3 is a view similar to FIG. 2 showing sensing of the body portion of the pin.
Figure 8:
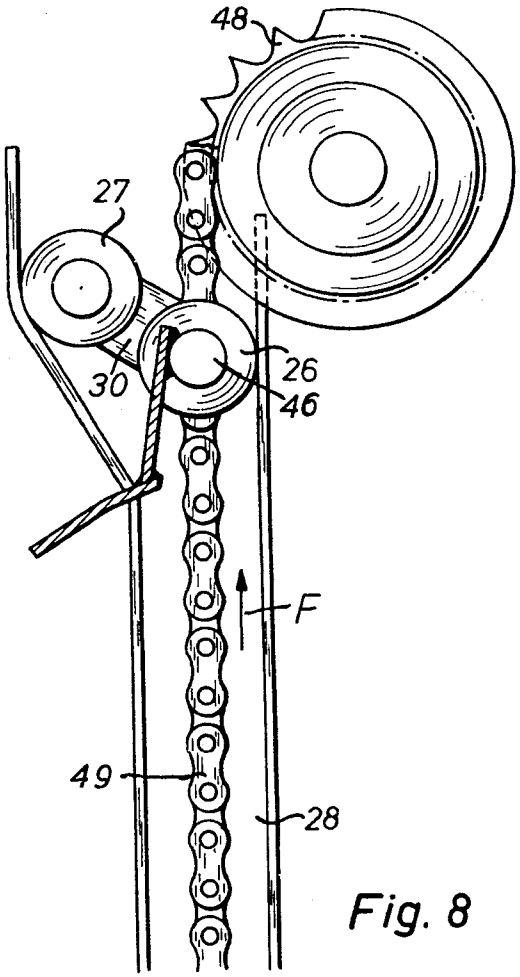
FIG. 8 is a view similar to FIG. 7, without, a bowling pin.
Figure 7:
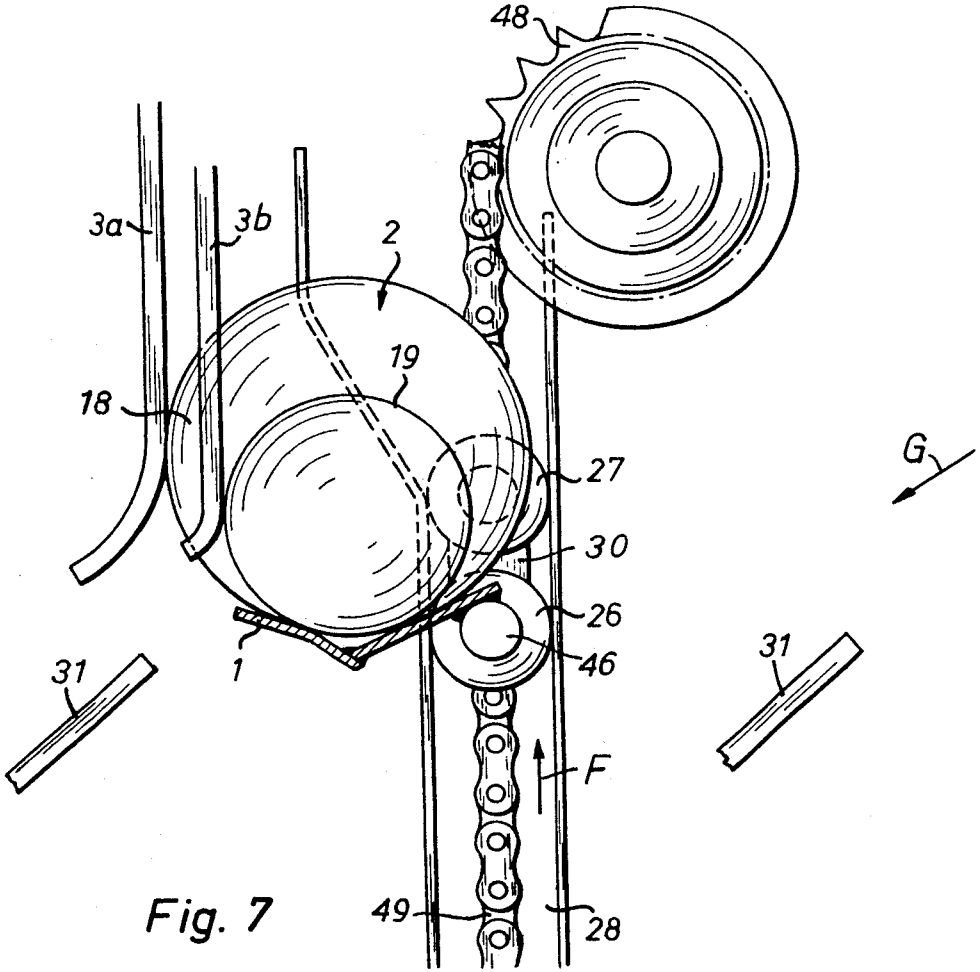
FIG. 7 is a side view of a pin elevator apparatus, to which the sensing mechanism of the present invention has been applied, and illustrating a release arrangement for the pin.

Sensing levers 3*a*, 3*b* are located adjacent the upper region, that is, adjacent the release position of the transport mechanism 48, 49. The levers 3*a*, 3*b* effect orientation of the pins 2 from the holders 1, as they are released, in a uniform direction. The pins may be loaded on the holder 1 oriented as shown in FIG. 1, or may be located thereon in reverse direction, that is, with the head and neck portion of the bowling pin facing towards the left, rather than towards the right as shown in FIG. 1. The orientation of the bowling pins is necessary due to the random placement of the pins on the holders 1, as they are supplied to the transport mechanism. The uniform alignment and orientation of the bowling pins 2, in accordance with the present invention, causes the pins to always fall with their bottom or support portion 22 first, or downwardly. This orientation is obtained by the two levers *3a*, *3b*. The levers *3a*, *3b* are so interconnected that the specific one of the levers which senses, and is engaged with the neck portion 20, or the head portion 19 of the bowling pin, is restrained in its quiescent or fixed position; that one of the levers which engages the body portion 18 of the pin 2, however, is permitted to carry out freely swinging movement in the direction of the arrow E (FIG. 3). Upon tipping of the pin holder 1, therefore, the excess weight of the body portion 18 of the pin 2 will cause tipping of the bowling pin in the direction of the arrow B (FIG. 1), that is, support portion 22 first, that is, downwardly. The head portion 19 of the bowling pin is prevented from dropping by the arrested or locked lever *3b*. The lever *3a*, however, which engages the body portion 18 of the pin 2 is freely movable in the direction of the arrow E (FIG. 3) and does not interfere with the tipping and falling of the respective bowling pin 2. As a result, pin 2 will always tip with the support surface 22 first, regardless of whether it is located on the holder 1 in the position shown in FIG. 1, or located thereon reversed by 180°. After pin 2, released from the holder 1, has tipped by a certain angle, the head portion 19 thereof will tilt outwardly from behind the associated lever *3b*, thus completely releasing the pin 2, so that it can be transported to the pin spotting apparatus, support portion first, over chute 31 (FIGS. 7, 8).

During the upward movement of the bowling pins on the holder 1, laterally arranged centering elements, such as sheet metal rails 9 engaging in slits 17 of the holders, provide for placement of the bowling pins on the respective holder 1 in the position shown in FIG. 1, at least just before the bowling pins reach the discharge position, that is, where they are engaged by the lever arms *3a*, *3b*. Thus, one of the lever arms will always engage the widest region of the body portion of the pin, and the other lever arm will engage the neck or head portion of the bowling pin. That lever arm which engages the pin in the region of greatest diameter, that is, in the region of the body portion 18, is thus moved in the direction of the arrow E before the other lever arm which engages the head 19, or the neck portion 20, if the other lever arm is moved at all. In FIG. 1, lever arm *3a* is the one which is deflected first.

Figure 2:
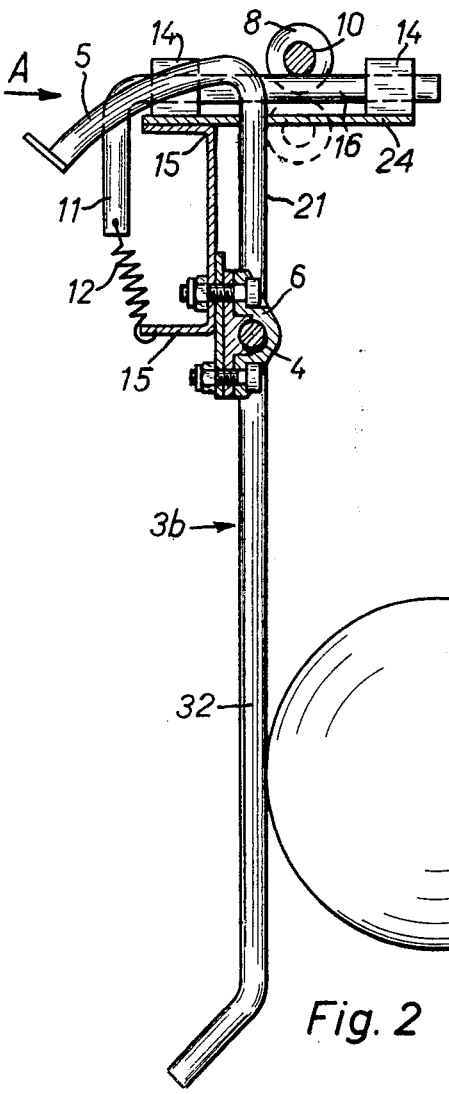
FIG. 2 is a side view of the apparatus showing sensing of the head or neck portion of a pin.
Figure 4:
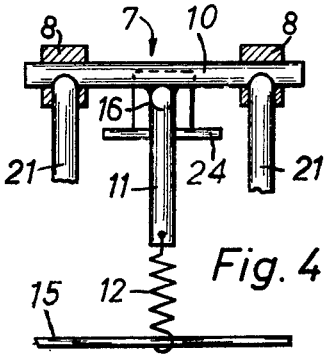
FIG. 4 is a view of the apparatus of FIG. 2 in direction of the arrow A.
Figure 5:
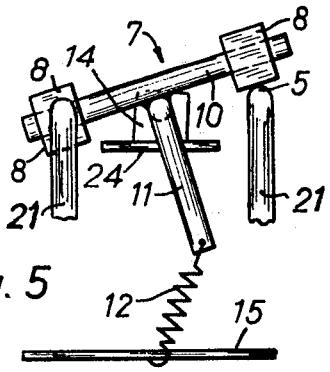
FIG. 5 is a view of the apparatus of FIG. 3 taken in the direction of arrow A.

The lever arms *3a*, *3b* (FIGS. 2, 3) are formed with an elongated sensing extension 32, extending downwardly over the pins 2 from a bearing 6. The arms are laterally upset to form a pivot or fulcrum axis 4 extending into the bearing 6, and are then upwardly bent to form a locking portion 21, to which a bent-over portion 5 is joined. The arms may be made as unitary elements, or the various portions can be separately made and connected, for example by welding or other connection. Preferably, the two arms *3a*, *3b* are the mirror image of each other, and are made of a single suitably shaped round steel rod. The bent-over portion 5 is so shaped that it is arcuate, with a radius the center of which is the pivot or fulcrum axis 4. A rocker 7 (FIGS. 1, 4, 5) is located behind the locking portions 21 of the arms. Rocker 7 can rock about a fulcrum axis 16, which extends transversely to the axis 4 of the two arms *3a*, *3b*. The rocker includes an essentially cylindrical transverse element 10, the ends of which have rollers 8 secured thereto. This cross arm 10 is rigidly connected to the rocker shaft 16. Rocker 7 is pivotally held in bearings 14, supported by a bearing plate 24 (FIGS. 2, 3). The shaft 16, forming the fulcrum or rocking axis for the rocker, is downwardly angled and connected to a weak tension spring 12, the other end of which is hooked into a rail 15 secured to a holding bracket which also supports bearins 6. Spring 12 has the tendency to hold the rocker 7 in the quiescent position shown in FIG. 4.

Rocker 7 and the two rollers 8 are provided to permit one of the arms *3a*, *3b*, respectively, which engage a pin 2, to swing freely in the direction of the arrow E (FIG. 3) while simultaneously locking swinging movement of the other.

Operation: As soon as one of the arms (as illustrated, arm *3a*) engages the body portion 18 of a pin 2, it is deflected in the direction of the arrow E, FIG. 3. This deflecting movement will occur before the other arm, *3b*, which is located in the region of the neck 20, or of the head 19 of the pin, can deflect. Rocker 7 is deflected as soon as the arm *3a* is engaged by the body portion 18 of a pin 2, since the bent-over portion 5 of the respective arm will engage the roller 8 at the end of rod 10, to lift the respective roller (see FIGS. 3, 5). Deflection of the rocker 7 moves the other roller 8, that is, the roller which is not engaged by the arcuate portion, behind the locking portion 21 of the arm *3b*. Arm *3b* thus cannot deflect anymore in the direction of the arrow E (FIG. 3) but, rather, is mechanically locked so long as rocker 7 is in the deflected position illustrated in FIG. 5, and thus is capable of holding the head and neck portion of the pin in position.

The arm *3b* which loosely engages the head portion 19 of pin 2 thus retains pin 2 and holds it in position upon tipping of the pin holder 1 (FIGS. 7, 8). As the pin drops, with the heavier body portion first, the head will twist out of the restrained position behind the arm *3b* and can fall freely, or at an angle, on the chute 31, to be transported to a suitable pin spotting apparatus.

Let is be assumed that a pin 2 is supplied by the holder 1 in a position reversed with respect to that shown in FIG. 1. In that case, arm *3b* will deflect first, and arm *3a* will hold the head and neck portion of the reversely placed pin, so that, again, the pin 2 will fall foot first when the holder 1 is tilted out of the holding position.

The apparatus as described shows a mechanical interlock. It is equally possible to use an electromagnetically hydraulically or pneumatically operating interlock, that is, an interlock relying on external forces for operation. The interlock and orientation system described so far is operated solely by the weight of the pin, and by the force due to movement of the pin by the transport mechanism, which permits deflection of the respective arm.

Figure 9:
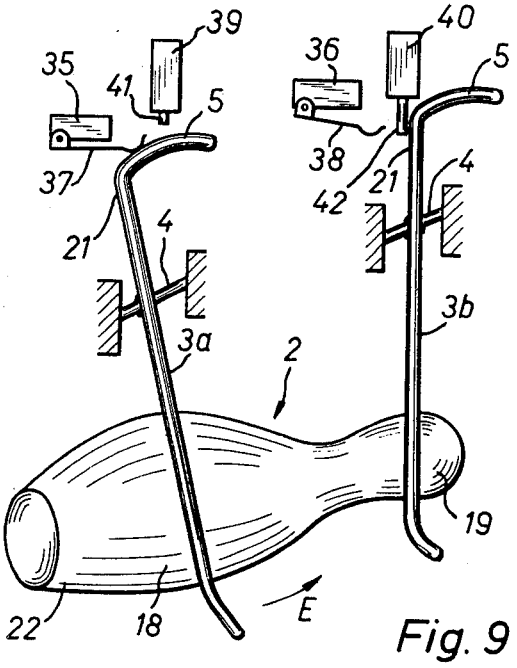
FIG. 9 illustrates an electromagnetic interlock arrangement for the sensing and holding levers.
Figure 10:
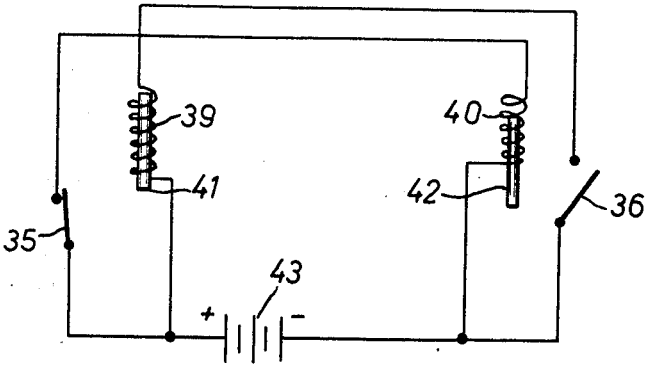
FIG. 10 is an electric circuit diagram to illustrate the connection of the system of FIG. 9.

Referring to FIGS. 9 and 10: The arms *3a*, *3b* are secured as described in connection with FIGS. 1–6; each one of the arms has a switch 35, 36 with engagement arms 37, 38 associated therewith. The switches 35, 36 are connected to solenoids 39, 40 which have plungers 41, 42, the arrangement being so made that an energization source, schematically shown as a battery 43 (FIG. 10) energizes the solenoid magnet associated with the arm which is not operating a switch. The solenoid magnets 39, 40 each have a plunger 41, 42 associated therewith which engages behind the locking portion 31 of the respective arm. Whichever arm is deflected first causes closing of the respective contact, thus energization of the other solenoid, blocking deflecting movement of the other arm, which holds the other arm in position and, additionally, prevents movement of the other arm in a position which could cause operation of the respective switch, as is clearly apparent from FIGS. 9 and 10. The electrical switches and magnets could equally be replaced by pneumatic or fluid pressure operated valves and plungers.

Various changes and modifications may be made within the scope of the inventive concept.

I claim:

1. Bowling pin alignment apparatus to uniformly orient and align bowling pins end-for-end upon being applied to the apparatus in randomly oriented position comprising means (1) temporarily supporting a bowling pin (2) in essentially horizontal position; means for moving the bowling pin;

two sensing and holding levers (*3a*, *3b*) located in horizontally spaced position and engageable with the bowling pin body portion (18) and the neck portion (19, 20) respectively upon movement of the pin; and interlock means (7, 8, 21; 41, 42) operatively connected to both said levers and locking that one of the levers (FIG. 1: *3b*) engaging the neck poriton (19, 20) of the pin (2) therebeneath, while releasing movement of the lever (*3a*) which engages the body portion (18) therebeneath, whereby, upon disengagement between said support means (1) and the pin (2), the pin will fall due to the greater weight of the body portion with the body portion first, downwardly, while being restrained by that one of the levers engaging the neck portion to thereby align and orient the pin with the body portion in downward direction.

2. Apparatus according to claim 1, wherein the support means (1) includes the moving means and comprises an elevator apparatus (23) and holders (1) secured to said elevator apparatus, the holders being movable from a pin supporting position to a pin releasing position, the pin being temporarily restrained upon release thereof due to movement of the pin holder to the pin releasing position by that one of the arms which engages the neck portion (19, 20) thereof.

3. Apparatus according to claim 1, wherein the pin support means are movable to tilt about an essentially horizontal axis to permit rolling-off of the pins therefrom;

and said interlock means (7, 8, 21; 41, 42) comprise means engageable with that one of the arms which does not engage the body portion (18) of the pin and restraining that one of the arms to retard release of the neck portion (19, of the pin upon its release from the support means (1) so that the pin will be released from the support means (1) bottom and body portion first and forward to thereby orient the pin.

4. Apparatus according to claim 3, wherein the interlock means comprises a rocker (7) rocked from a neutral position upon engagement by the arm being engaged by the body portion (18) of the pin (2) and blocking movement of that one of the arms which is opposite the neck portion (19, 20) of the pin.

5. Apparatus according to claim 1, wherein the levers comprise a sensing portion (32) extending in the direction of the bowling pin;

bearing means (6) are provided, journalling the levers for swinging movement to deflect upon engagement of the sensing portion (32) with the body portion (18) of the pin (2);

a locking portion (21) formed on the levers, and an arcuate portion (5) joined to the locking portion, said arcuate portion having a center congruent with the bearing axis;

and wherein said interlock means comprises a rocker (7) having a rocking axis (16) extending transversely to the bearing axis of said bearing (6), the rocker being positioned to be engaged by the arcuate portion (5) of the arm upon deflection of that one of the arms engaging the body portion (18) of the pin and moving into interfering position with respect to the other one of the arms, to lock the other one of the arms against deflection.

6. Apparatus according to claim 5, further comprising positioning means (9) located adjacent the support means (1) and locating the pins (2) in predetermined position on the support means, and hence in predetermined position with respect to the position of the levers (*3a*, *3b*).

7. Apparatus according to claim 1, wherein the interlock means comprises a source of power;

control means operatively associated with each one of the arms, said control means being operated upon deflection of any one of the arms; and locking means individually engageable with the individual arms, the control means of one arm being connected to operate the locking means of the other, so that, upon deflection of one of the arms sensing the body portion (18) of a pin, the other one of the arms will be locked in position to restrain the neck portion (19, 20) from movement upon tilting of the pin supporting means.

8. Apparatus according to claim 7, wherein the control means comprise electrical switches, and the locking means comprise a solenoid and plunger.

9. Apparatus according to claim 1, wherein the levers (*3a*, *3b*) are formed with control portions (5);

a rocker mechanism (7) is provided, located in engageable position with respect to said control portions;

and, when moved to deflected position by one of the arms inhibiting deflection of the other of the arms by engagement with a locking portion of the other of the arms.

10. Apparatus according to claim 1, wherein the interlock means comprises means (5, 8) engaged by and operated upon deflection of one of the levers, and movable to block deflection of the other of the levers, whereby deflection of one of the levers upon engagement with the body portion of the pin will lock the other lever in engaged position with the neck portion of the pin and restrain free release of the neck portion of the pin upon disengagement between the pin and said support means.

* * * * *